US009995110B2

(12) United States Patent
Cleven

(10) Patent No.: US 9,995,110 B2
(45) Date of Patent: Jun. 12, 2018

(54) METHODS AND SYSTEMS FOR STIMULATING AND RESTIMULATING A WELL

(71) Applicant: Peter Kris Cleven, Grand-Barachois (CA)

(72) Inventor: Peter Kris Cleven, Grand-Barachois (CA)

( * ) Notice: Subject to any disclaimer, the term of this patent is extended or adjusted under 35 U.S.C. 154(b) by 162 days.

(21) Appl. No.: 15/197,158

(22) Filed: Jun. 29, 2016

(65) Prior Publication Data

US 2018/0003003 A1 Jan. 4, 2018

(51) Int. Cl.

| | |
|---|---|
| ***E21B 34/10*** | (2006.01) |
| ***E21B 43/25*** | (2006.01) |
| ***E21B 33/128*** | (2006.01) |
| ***E21B 34/06*** | (2006.01) |
| *E21B 34/00* | (2006.01) |
| *E21B 43/26* | (2006.01) |

(52) U.S. Cl.

CPC ..... *E21B 34/102* (2013.01); *E21B 33/1285* (2013.01); *E21B 34/063* (2013.01); *E21B 43/25* (2013.01); *E21B 43/26* (2013.01); *E21B 2034/007* (2013.01)

(58) Field of Classification Search

CPC ..... E21B 23/08; E21B 23/10; E21B 33/1285; E21B 34/063; E21B 34/102; E21B 43/25; E21B 43/26

See application file for complete search history.

(56) References Cited

U.S. PATENT DOCUMENTS

| | | | | |
|---|---|---|---|---|
| 3,251,416 | A * | 5/1966 | Kiel | E21B 41/00 166/183 |
| 5,174,379 | A | 12/1992 | Whiteley et al. | |
| 5,209,304 | A * | 5/1993 | Nice | E21B 23/10 166/154 |
| 5,568,837 | A * | 10/1996 | Funk | E21B 19/00 166/383 |
| 2004/0118565 | A1* | 6/2004 | Crawford | E21B 4/18 166/312 |
| 2012/0111566 | A1 | 5/2012 | Sherman et al. | |
| 2013/0333883 | A1* | 12/2013 | Ehtesham | E21B 43/00 166/255.1 |
| 2014/0034308 | A1* | 2/2014 | Holderman | E21B 34/08 166/279 |
| 2014/0116724 | A1* | 5/2014 | McDougall | E21B 23/08 166/380 |

OTHER PUBLICATIONS

Written Opinion of the ISA, dated Aug. 1, 2017, PCT/US/2017/032822.

* cited by examiner

*Primary Examiner* — Waseem Moorad
*Assistant Examiner* — Christopher J Sebesta
(74) *Attorney, Agent, or Firm* — Pierson IP, PLLLC

(57) ABSTRACT

Embodiments disclosed herein describe fracturing methods and systems, wherein pressure differentials and fluid flow rates may be utilized to stimulate multiple zones, sleeves, or ports with the same tool.

17 Claims, 7 Drawing Sheets

METHODS AND SYSTEMS FOR STIMULATING AND RESTIMULATING A WELL

BACKGROUND INFORMATION

Field of the Disclosure

Examples of the present disclosure relate to systems and methods for stimulating a well.

Background

For purposes of communicating well fluid from surface and vice versa, the well may include tubing. The tubing typically extends downhole into a wellbore of the well for purposes of communicating well fluid from one or more subterranean formations through a central passageway of the tubing to the well's surface. However, there is a limit to how far downhole tubing can be pushed before friction and buckling becomes excessive. As a consequence, this may limit the length of the well where a down hole tool may be conveyed, limiting the ability to treat or intervene in extended or long reach wells.

Hydraulic fracturing is performed by pumping fluid into a formation at a pressure sufficient to create fractures in the formation. When a fracture is open, a propping agent is added to the fluid. The propping agent, e.g. sand or ceramic beads, remains in the fractures to keep the fractures open when the pumping rate and pressure decreases.

In conventional applications, sand and gravel from the formation enters the annulus between an outer diameter of a tool and an inner diameter of the tubing. The propping agent in the annulus prevents the string and injection assembly from moving to the next target zone or to the surface.

Accordingly, needs exist for system and methods for fracturing utilizing a dart to pull or push tubing further down a well, while controlling pressure and fluid through an outer diameter and an inner diameter to activate a tool to perform treatment at a first valve, reset the tool, move the tool, and reactivate the tool to perform treatment over a second valve.

SUMMARY

Embodiments disclosed herein describe fracturing methods and systems, wherein pressure differentials and fluid flow rates may be utilized to stimulate multiple zones, sleeves, or ports with the same tool and different conveying method (i.e.: Coiled Tubing, Stick Pipe).

In embodiments, a hole may be run with tubing. A tool with a dart may be positioned within the tubing. Fluid may be pumped in an annulus between the tool and the tubing applying pressure on the dart to push and/or pump the tool further down the well. Responsive to the fluid being applied in the annulus to the dart, fluid positioning below a first end of the dart may flow into the inner diameter of the tool through a passageway within the dart and an open port on a first end of the tool.

Responsive to the tubing being pushed and/or pumped to a desired depth, a fluid flow rate through the inner diameter of the tool may be increased. This may close a check valve causing the pressure within the inner diameter of the tool to increase. The increase in pressure within the inner diameter of the tool pushes a piston to move and shear off the dart. Furthermore, when the piston moves, a shifting profile on the tool may be activated. In embodiments, the shifting profile may be permanently opened when activated.

Next, the tool may be moved towards a proximal end of the tubing until the activated shifting profile engage with a locking or female profile (referred to hereinafter individually and collectively as "female profile") positioned on the inner diameter of the casing. When the shifting profile is aligned with the female profile, a force differential may occur, allowing monitoring devices and/or gauges at the surface to remotely indicate that the shifting profile engaged with the female profile.

After the force differential occurs, fluid may flow through the inner diameter of the tool until the check valve shifts to activate the tool. When the tool is activated, a seal packer may expand to assist in creating a piston force on a valve sleeve. This piston force may force the valve sleeve to move downward to expose a valve port, and to align the valve sleeve with a stimulation port through the casing. Fluid flow within the annulus may be increased, and treatment may be performed over the outer diameter of the tool and out to the geological formation.

In embodiments, during treatment of a zone, it may be required to maintain pressure on the inner diameter of the tool to keep the seal packer activated to maintain the seal for treatment. When treatment of the zone is complete, pressure on the inner diameter of the tool is bleed off, which may allow the tool to reset. The tool may be reset by moving the tool towards a proximal end of the tubing, disengaging the shifting profile from the female profile. At this time, debris within the tool and well may be cleaned via circulation (i.e.: reverse or direct circulation). Once done, the procedure may repeat, and the next valve may be opened and treated. In embodiments, the shifting profile and the female may limit or restrict the downward movement of the tool.

In embodiments, multiple valve or ports may be installed on a casing that are positioned at a predetermined distance apart. This predetermined distance will allow for future re-fracing pre-spaced out sealing tools to be conveyed to the well, isolating various opened ports simultaneously in a string in order to eliminate cross flow from secondary open ports.

In embodiments, a locator and multiple packers may be positioned below and above the valve. Further up the string, a new packer may seal off the ports in a pre-installed valve. This may eliminate or reduce communication in the formations between the zones or stages. When one sleeve has been refractured, fluid flow may be stopped. Then, the tool may be reset and moved to the next valve until the force differential occurs to indicate the correct placement of the tool.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
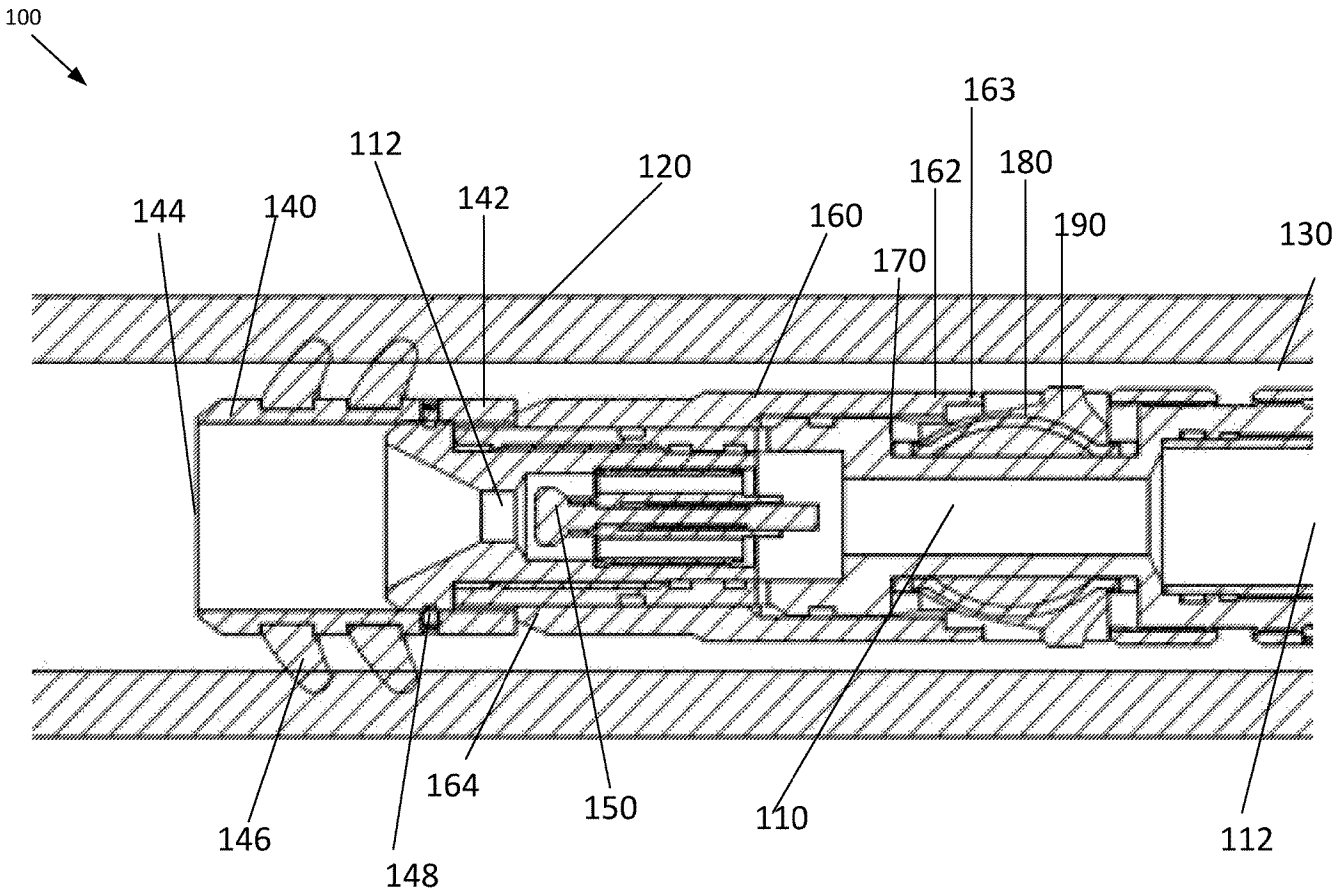
FIG. 1 depicts a system for stimulation a well, according to an embodiment

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a fracturing system 100, according to an embodiment. System 100 may include tool 110 and casing 120, wherein there may be an annulus 130 between an outer diameter of tool 110 and an inner diameter of casing 120.

Tool 110 may include a hollow chamber extending from a proximal end of tool 110 to a distal end of tool 110. The distal end of tool 110 may include port 112. Port 112 may have a smaller diameter than the inner diameter of tool 110 and may be configured to control fluid flowing through the inner diameter of tool 110. Additionally, port 112 may be configured to control pressure levels within the inner diameter of tool 110. Tool 110 may include a dart 140, coupling mechanisms 148, check valve 150, piston sleeve 160, ledge 170, locking mechanism 180, and shifting profile 190.

Dart 140 may be removably coupled to a distal end of tool 110, and be configured to pull and/or push conveying tubing 112 and tool 110 downwell. In embodiments, dart 140 may be configured to be coupled with any type of tool, tubing, device, etc. Dart 140 may have a larger diameter than the second end of tool 110, such that an inner circumference of dart 140 is positioned adjacent to an outer circumference of tool 110. Dart 140 may include a first end 142, second end 144, and projections 146, wherein there may be a hollow chamber extending between first end 142 and second end 144.

First end 142 may be configured to be positioned over a distal end of tool 110. Projections 146 may be rubber extensions extending across annulus 130, wherein projections 146 are configured to receive fluid flowing through annulus 130. In embodiments, there may be a limit as to how far down well tubing 112 may be pushed due to buckling. To increase the distance over which tubing 112 120 may be pulled and/or pushed downward, fluid flowing through annulus 130 may cause dart 140 to pull and/or push tubing 112 further down well. Responsive to the fluid flowing below second end 144 of dart 140, the fluid may enter the hollow chamber within dart 140, and exit dart 140 into tool 110 via port 112. This fluid may then flow out of the proximal end of tool 110. In embodiments, dart 140 may be configured to be sheared away from tool 110 based on pressure increase within the inner diameter of tool 110.

However, in other embodiments, dart 140 may be sheared from tool in different methods. For example, dart 140 may be sheared from tool 110 by increasing the pressure on the outer diameter and restricting the movement of tool 110. This pressure may create an increasing downward force. Responsive to the pressure on the outer diameter of dart 140 increasing past a threshold, dart 140 may be sheared from tool 110. In further embodiments, a restriction, projector, ledge, edge may be installed within the well or casing 120. When dart 140 passes through the restriction, the restriction may release dart 140 from tool 110. Other embodiments may utilize a ball to release dart 140, wherein the ball may be dropped within the well causing a sleeve to shift to release dart 140.

Furthermore, embodiments may include drag blocks or friction devices that are configured allow dart 140 to be removed from a well. The drag blocks or friction devices may be configured to interface with projections 146, wherein projections 146 may be comprised of rubber. Responsive to moving dart 140 towards the proximal end of the well, rubber projection 146 may be sheared from dart 140. One skilled in the art may appreciate the drag blocks or friction devices may be used in combination with J-Slots.

Check valve 150 may be positioned within the inner diameter of tool 110, and be configured to move in a linear axis in parallel to the longitudinal axis of tool 110. Check valve 150 have a smaller diameter than that of tool 110, such that fluid may flow between check valve 150 and the inner diameter of tool 110. Check valve 150 may have a first end having a first diameter and a second end having a second diameter. The first diameter may be smaller than a diameter of port 112, and the second diameter may be larger than the diameter of port 112. In a first orientation, the second end of check valve 150 may be configured to be positioned away from the port 112 to allow fluid to flow across port 112. Alternatively, in a second orientation, a second end of check valve 150 may be configured to be positioned adjacent to port 112 to restrict, limit, inhibit, etc. fluid from flow across port 112 and/or to increase the pressure within tool 110. Accordingly, check valve 150 may be a device allowing fluid to flow through port in both linear directions. By allowing fluid flow in multiple directions, the fluid may flow over tool 110 to clean areas of sand or debris within tool 110, if required. Furthermore, check valve 150 may eliminate the need for a toe sub, as embodiments are able to take return fluid through the inner diameter of tool 110.

In embodiments, responsive to increasing fluid flow through the inner diameter of tool, the second end of check valve 150 may move from the first orientation to the second orientation to close check valve 150. When check valve 150 is closed, pressure within the inner diameter of tool 110 may increase to push piston sleeve 160 to shear dart 140 off tool 110. In embodiments, responsive to decreasing pressure through the inner diameter of tool 110, check valve 150 may move from the second orientation to the first orientation. This may cause the second end of check valve 150 to move away from port 112 to open check valve 150. However, one skilled in the art may appreciate that check valve 150 may be opened or closed in multiple manners, such as dropping a ball to open or close check valve 150.

Piston sleeve 160 may be positioned on an outer diameter of tool 110, and may be positioned between shifting profile 190 and dart 140. Piston sleeve 160 may be configured to move along a linear axis in parallel to the longitudinal axis based on a pressure level within the inner diameter of tool 110. Piston sleeve 160 may include first end 162 with outcrop 163, and second end 164. When check valve 150 is closed, a first end 162 and outcrop 163 of piston sleeve 160 may overhang ledge 170. The first end 162 of piston sleeve 160 may be configured to suppress shifting profile 190 from expanding. When check valve 150 is opened, first end 162 of piston sleeve 160 may slide to not cover ledge 170. This may allow locking mechanism 180 to expand. When check valve 150 is initially opened, second end 164 may be positioned adjacent to port 112. Responsive to closing check valve 150 and moving piston sleeve 160 towards the distal end of tool 110, causing second end 164 to apply force against and shear dart 140 from tool 110.

Ledge 170 may be a sidewall positioned on the outer diameter of tool 110. By positioning outcrop 163 and/or first end 162 of piston sleeve 160 over ledge 170, the outward movement of shifting profile 170 and/or locking mechanism 180 may be suppressed.

Locking mechanism 180 may be a device that is configured to retract, compress, extend, elongate, etc. For example, locking mechanism 180 may be a spring. Locking mechanism 180 is configured to move shifting profile 190 responsive to locking mechanism 180 being extended or compressed. Locking mechanism 180 may be extended or compressed based on the positioning of piston sleeve 160. When piston sleeve 160 is positioned over ledge 170, an inner surface of piston sleeve 160 may restrict the outward movement of locking mechanism 180, such that locking mechanism 180 remains compressed. When first end 162 of piston sleeve 160 does not extend over ledge 170, locking mechanism 180 may be elongated.

Shifting profile 190 may be a device that is configured to allow tool 110 to move along an axis parallel to the longitudinal axis of tool 110 while in a first position, and restrict the movement of tool 110 in a second position.

In the first position, locking mechanism 180 may be compressed and an outer surface of shifting profile 190 may be aligned with an outer diameter of tool 110, such that the outer surface of shifting profile 190 is positioned away from an inner diameter of casing 120. In the second position, locking mechanism 180 may be extended and an outer surface of shifting profile 190 may extend across annulus 130 and be embedded within a female profile on the inner diameter of casing 120. Responsive to interfacing shifting profile 190 with the female profile, tool 110 may be secured in place. However, a sufficient upward force on tool 110 may disengage shifting profile 190 from the female profile Tubing 112 may be a pipe, coil, etc. extending from a surface level into a geological formation. Tubing 112 may be configured to be pulled and/or pushed into the desired depth within the well bore via dart 140.

Casing 120 may include a profile that includes a female profile, indention, depression, etc., which may be configured to receive shifting profile 190 to secure tool 110 in place. Casing 120 may be installed in a well before tool 110 is run into the well. Furthermore, casing 120 may include channels, passageways, and conduits extending from a first location on an inner diameter of casing 120 to a second location on the inner diameter of casing 120 to control, maintain, or change the pressure on different sides of a sealing packer element on the tool. Casing 120 may also include channels, passageways, and conduits extending through the casing 120 to perform treatment out of the geological formation.

Figure 2:
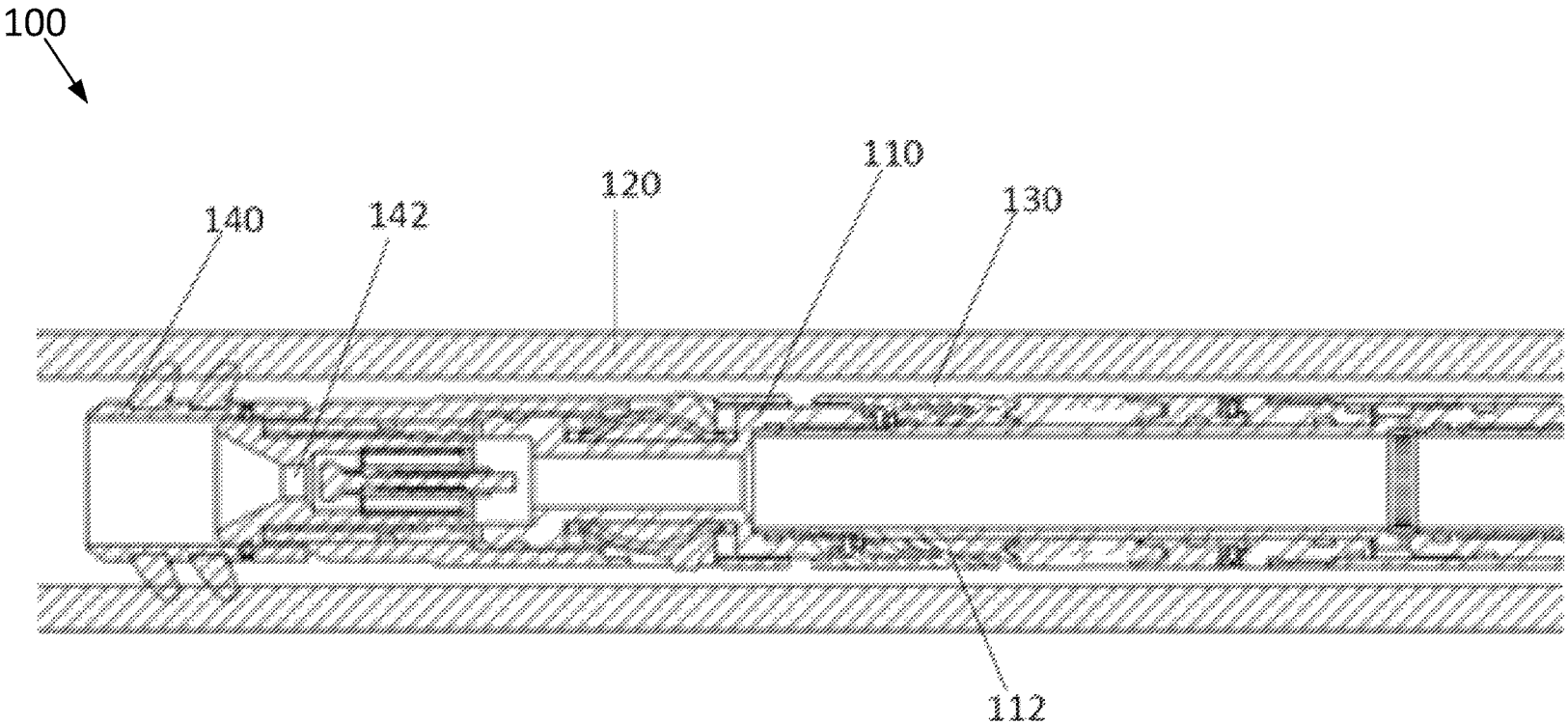
FIG. 2 depicts a system for stimulation a well, according to an embodiment

FIG. 2 depicts system 100, according to an embodiment. Elements depicted in FIG. 2 may be substantially the same as those described above. For the sake of brevity an additional description of those elements is omitted.

As depicted in FIG. 2, a hole may be run with tubing 112. Due to a limit to how far tubing 112 may be pushed down due to friction, buckling, etc., to increase the amount of distance tubing 112 is displaced into well bore, fluid may be pumped through annulus 130. This fluid may pull/push dart 140, tool 110, and tubing 112 down the well. Because check valve 150 may be in an open position, when the fluid flows past dart 140, the fluid may flow into the inner diameter of dart 140 and tool 110 via port 142. This fluid may return upward through the well via tool 110 and tubing 112.

Figure 3:
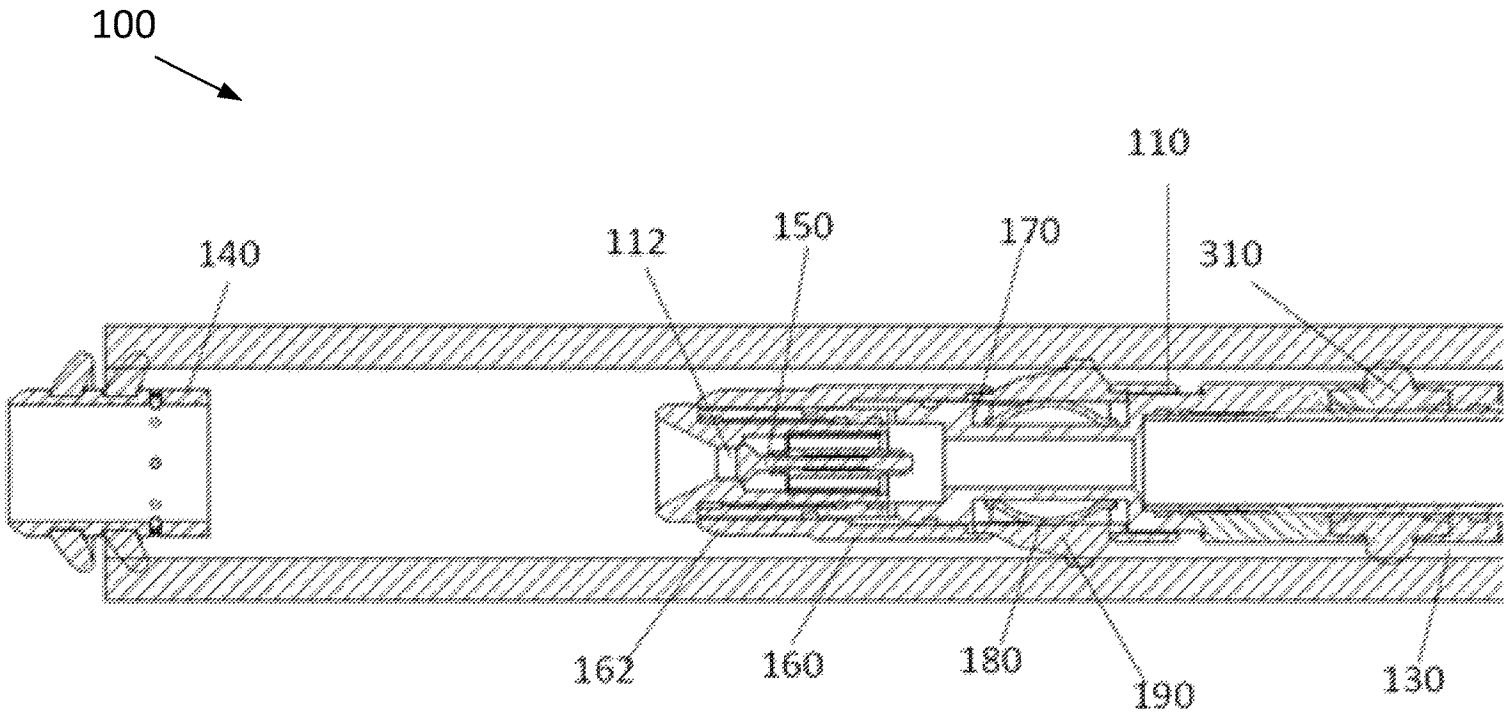
FIG. 3 depicts a system for stimulation a well, according to an embodiment

FIG. 3 depicts system 100, according to an embodiment. Elements depicted in FIG. 3 may be substantially the same as those described above. For the sake of brevity an additional description of those elements is omitted.

In FIG. 3, tubing 112 may reach a desired depth, and fluid flowing through an inner diameter of tool 110 may increase. The increase in fluid rate may force check valve 150 to move linearly towards the distal end such that the second end of check valve 150 is positioned adjacent to and covering port 112. By closing check valve 150, the pressure within the inner diameter of tool 110 may increase. The increase in pressure may cause piston sleeve 160 to move and shear off dart 140. The shearing of dart 140 may separate dart 140 from tool 110.

When piston sleeve 160 moves, first end 162 of piston sleeve 160 may traverse ledge 170. Responsive to first end 162 traversing ledge 170, locking mechanism 180 may expand and shifting profile 190 may be unlocked. When shifting profile 190 is unlocked, shifting profile 190 may extend across annulus 130. Furthermore, when shifting profile 190 is unlocked, packer 310 may be extended across annulus 130 at a pre-defined pressure.

Figure 4:
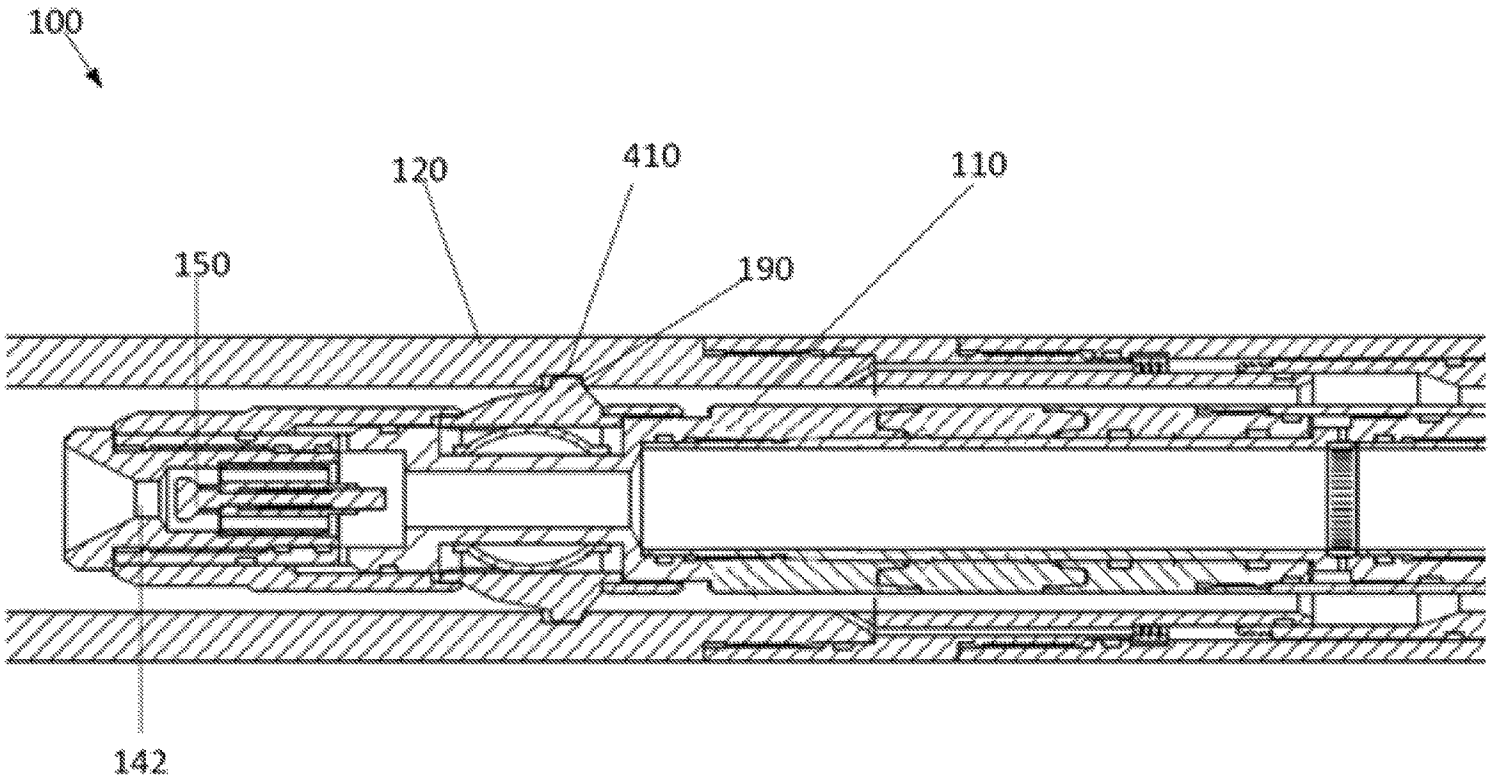
FIG. 4 depicts a system for stimulation a well, according to an embodiment

FIG. 4 depicts system 100, according to an embodiment. Elements depicted in FIG. 4 may be substantially the same as those described above. For the sake of brevity an additional description of those elements is omitted.

As depicted in FIG. 4, an inner diameter of casing 120 may include a female profile 410, wherein female profile 410 may be a depression, groove, indentation, etc. Female profile 410 may be configured to receive portions of shifting profile 190 to secure tool 110 in place. Responsive to tool 110 being moved along a linear path towards the proximal end of casing 120, shifting profile 190 may engage with and interface with female profile 410. When shifting profile 190 interfaces with female profile 410, a force differential may occur at a surface to indicate that the shifting profile is engaging with female profile 410.

Furthermore, due to a lack of pressure differential in favor of inner diameter of tool 110, check valve 150 may move away from port 112 and be in the open position.

Figure 5:
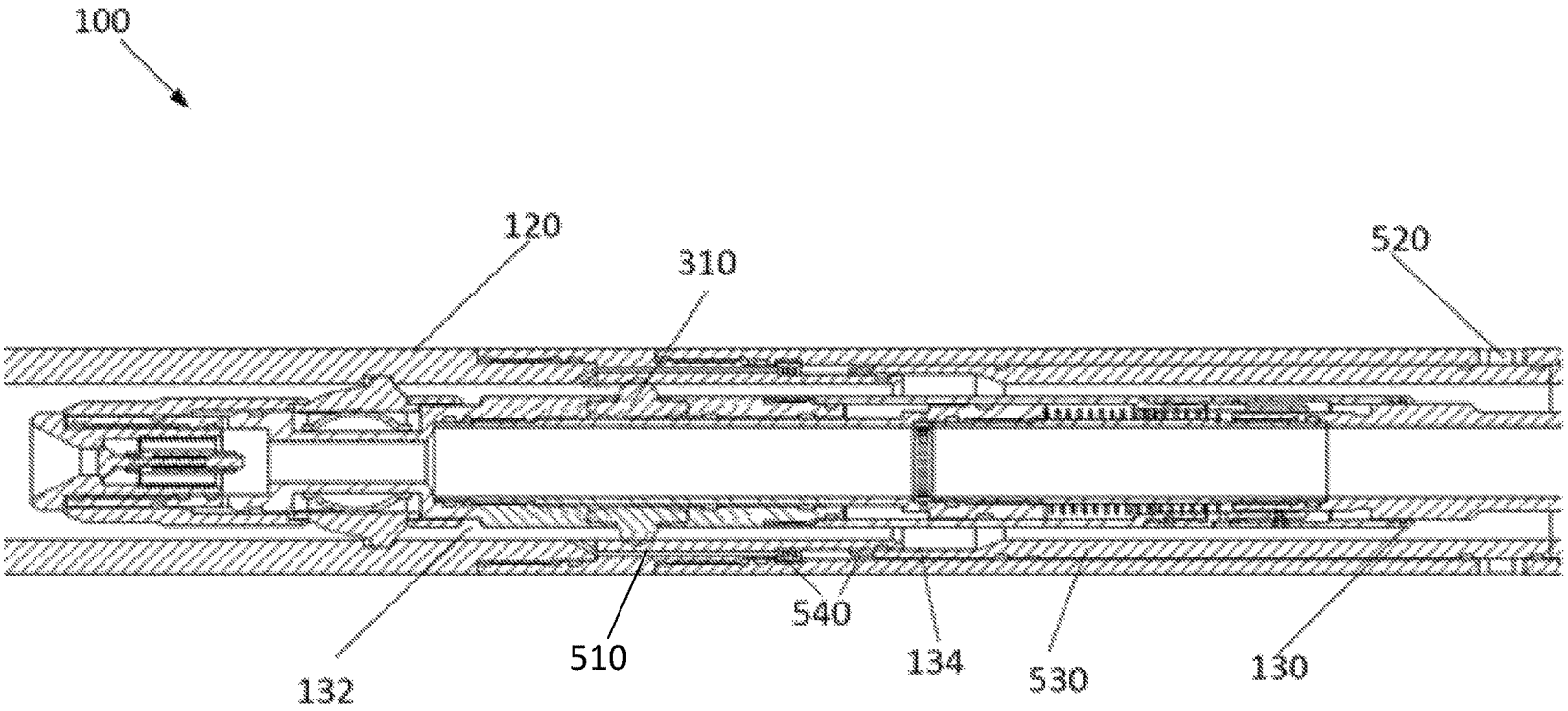
FIG. 5 depicts a system for stimulation a well, according to an embodiment

FIG. 5 depicts system 100, according to an embodiment. Elements depicted in FIG. 5 may be substantially the same as those described above. For the sake of brevity an additional description of those elements is omitted.

In FIG. 5, fluid may flow through the inner diameter of tool 110, which may close check valve 150. Responsive to closing check valve 150, packer 310 may be activated. When packer 310 is activate, portions of packer 310 may extend across annulus 130 and be positioned against the inner diameter of tubing 112. This may segregate the annulus 130 to include a lower end 132 and an upper end 134.

In embodiments, packer 310 is maintained in the activated state due to a predetermined pressure level inside tubing 112.

Additionally, as depicted in FIG. 5, system 100 may also include a stimulation port 520 and valve sleeve 530. Stimulation port 520 may be an orifice extending through casing 120, wherein stimulation port 520 is configured to dispense fluid flowing over the annulus 130 into the geological formation.

Valve sleeve 530 may be a sleeve positioned adjacent to the inner diameter of casing 120. Valve sleeve 530 may be configured to move in a direction parallel to the longitudinal axis of casing 120. Valve sleeve 530 may include a valve port that is configured to align with stimulation port 520 to be in an open position.

In the open position, fluid may flow out or in to stimulation port 520. However, if valve sleeve 530 is misaligned with stimulation port 520, a sidewall of valve sleeve 530 may not allow the fluid to flow outside of annulus 130. Furthermore, valve sleeve 530 may include a locking mechanism 540 that is configured to interface with a locking element within tubing 112. Responsive to interfacing locking mechanism 530 with the locking element, the valve port and the stimulation port 520 may remain in the open position.

Furthermore, system 100 may not require an atmospheric chamber, and valve sleeve 530 may not be activated by internal pressure alone. However, when packer 310 is activated, a pressure port 510 positioned below valve sleeve 530 creates a pressure differential between the lower annulus 132 and the upper annulus 134. When packer 310 is activated, valve sleeve 530 becomes a piston being able to shift open based on the pressure differential caused by packer 310 separating the upper and lower sections of annulus 130. Accordingly, without packer 310 being activated, the pressure differential may not occur and the sleeves may not open accidently, inadvertently, etc.

In embodiments, a benefit of a pressure activated sleeve system 100 is that one is able to pressure test the outer casing 120 for pressure integrity without a toe sub or without opening the sleeves during the process. Then, the well may be treated as required, sleeve by sleeve. Utilizing embodiments, a pressure differential may be created, and shift a sleeve without pulling on a tool string or tubing 112 to open or close the ports. By setting the tool 110 and providing pressure on the annulus 130, embodiments are able to open a specific port where the tool 110 is set. Then, embodiments may be treated over the tool 110 or tubing 112 into the completion.

Figure 6:
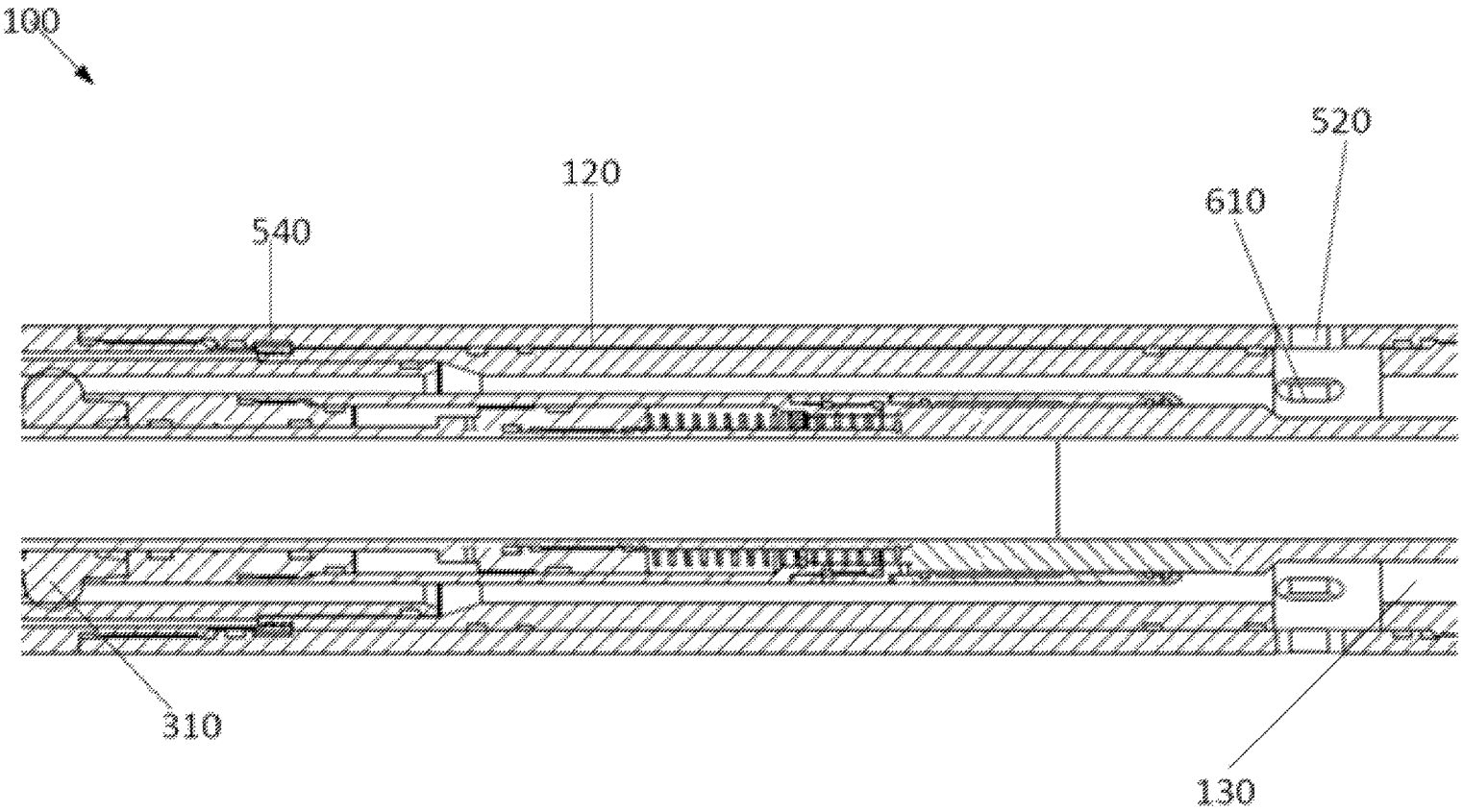
FIG. 6 depicts a system for stimulation a well, according to an embodiment.

FIG. 6 depicts system 100, according to an embodiment. Elements depicted in FIG. 6 may be substantially the same as those described above. For the sake of brevity an additional description of those elements is omitted.

In FIG. 6, when packer 310 is expanded, tool 110 creates a comparted annulus above and below the packer 310, when pressure is applied above the packer 310, a piston force on valve sleeve 530 is achieved to slide valve sleeve 530. Valve sleeve 530 may move towards the distal end of casing 120 so that valve port 610 is aligned with stimulation port 520. In embodiments, coupling mechanisms, such as shear screws, collets, detents, etc., may be configured to maintain valve sleeve 530 in a closed position before packer 310 is expanding separating annulus into the lower annulus 132 and the upper annulus 134. The coupling mechanisms may be configured to keep valve sleeve 530 from opening when elements are positioned within annulus 130. However, once tool 110 is set and packer 310 is expanded, the pressure increase on the upper annulus 134 that creates the piston force becomes greater than the coupling force of the coupling mechanisms. This may allow for the coupling mechanisms to be sheared, and valve sleeve 530 to be opened.

Responsive to aligning valve port 610 with stimulation port 520, fluid may flow from or to the annulus 130. Fluid flowing in annulus 130 may be increased, and treatment may be performed over the outer diameter of tool 110 and out into the geological formation. Additionally, when valve sleeve 530 moves, locking mechanism 540 may be engaged with the locking element.

It is desired that pressure is maintained on the inner diameter of packer 310 to keep packer 310 activated, keeping the seal for treatment. However, when treatment is completed, pressure on the inner diameter of tool 110 may bleed off, which may reset the tool 110. When tool 110 is reset, check valve 150 may open, closing packer 310. After tool 110 is reset, debris may be removed from around tool 110 and in the well. Upward force may then be applied to disengage shifting profile 150 from female profile 310. Tool 110 may then be pulled towards the proximal end of casing 120, align with a subsequent female profile, and treat a subsequent valve. Accordingly, tool 110 may be utilized to treat multiple valves within a string.

In embodiments, multiple valves or ports may be installed on casing that are positioned at a predetermined distance from each other. This predetermined distance will allow for packer sealing tools to be mounted on the future re fracturing string to eliminate cross flow from secondary open valves, i.e.: a valve or group of valves above or below the valve being operated. In embodiments, a locator and multiple packers may be positioned below and above a valve. Further up the string, a new packer may seal off the ports in a pre-installed valve. This may eliminate or reduce the flow out of the valves due to communication in the formation between the zones or stages. When one sleeve has been refractured, the tool may be reset and move to the next valve and operation repeated.

Figure 7:
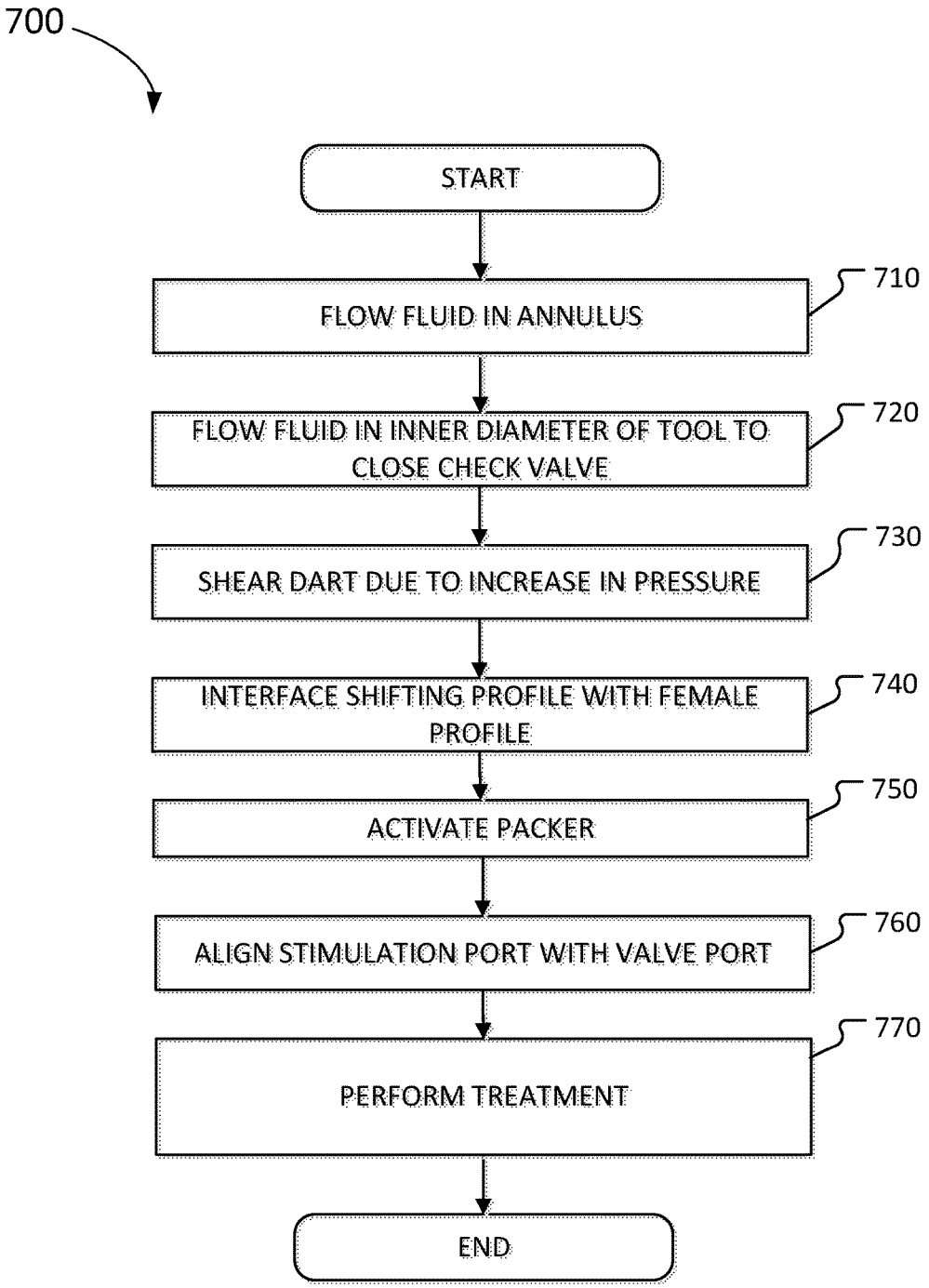
FIG. 7 depicts a method for stimulating a well, according to an embodiment.

FIG. 7 depicts a method 700 for stimulating a well. The operations of method 700 presented below are intended to be illustrative. In some embodiments, method 700 may be accomplished with one or more additional operations not described, and/or without one or more of the operations discussed. Additionally, the order in which the operations of method 700 are illustrated in FIG. 7 and described below is not intended to be limiting. Furthermore, the operations of method 700 may be repeated for subsequent valves or zones in a well.

At operation 710, fluid may flow within an annulus between an outer diameter of a tool and an inner diameter of a tubing to interact with a dart to pull and/or push the tubing downward.

At operation 720, fluid may flow through an inner diameter of tool from a proximal end of the tool towards the distal end of the tool. The fluid flowing through the tool may cause a check valve to close. Responsive to the check valve closing, the pressure within the inner diameter of the tool may increase.

At operation 730, due to the increase in pressure within the inner diameter, a piston sleeve may slide towards the distal end of the tool shearing off the dart. Additionally, responsive to the piston sleeve sliding, a shifting profile may be unlocked.

At operation 740, the tool may slide towards the proximal end of the tubing until the shifting profile interfaces with a female profile within the tubing. While the tool is sliding towards the proximal end of the tubing, the fluid flow rate through the inner diameter of the tool may decrease, and the check valve may be opened.

At operation 750, the fluid flow rate through the inner diameter of the tool may increase to close the check valve and activate the packer. Followed by pumping fluid in annulus, this may cause the pressure within the annulus to increase.

At operation 760, the increase in pressure may cause a valve sleeve to slide towards the distal end of the tubing to align a stimulation port with a valve port.

At operation 770, when the stimulation port and the valve port are aligned, treatment may be performed within the geological formation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for stimulating a well, the system comprising:

tubing with a hollow inner chamber extending from a proximal end to a distal end;

a dart configured to pull or push the tubing responsive to fluid flowing through an annulus positioned between an outer diameter of a tool and the inner diameter of a casing, wherein the dart is positioned on the distal end;

a check valve configured to move between a first mode and a second mode based on the pressure within the hollow inner chamber to cover and uncover a port positioned proximate to the distal end, wherein in a first mode the check valve does not cover the port and in a second mode the check valve does cover the port, the check valve having a first end and a second end, the check valve being configured to move between the first mode and the second mode while positioned within the tool;

a piston sleeve positioned on the tool configured to move towards the distal end of the tool responsive to the check valve when the check valve moves from the first mode to the second mode to shear the dart from the distal end covering the port; and a shifting profile configured to extend across the annulus responsive to the piston sleeve moving towards the distal end of the tool, wherein the piston sleeve is positioned between the shifting profile and the distal end.

2. The system of claim 1, wherein the casing includes a female profile positioned on an inner diameter of the casing, wherein the shifting profile is configured to align or engage with the female profile to secure the profile in place.

3. The system of claim 2, wherein the shifting profile is configured to disengage from the female profile to reset the tool when pressure within the inner diameter of the tool decreases.

4. The system of claim 1, further comprising:

a seal packer positioned on the outer diameter of the tool configured to expand responsive to the check valve covering the port, wherein the seal packer creates a seal when expanded.

5. The system of claim 4, including a pressure port configured to create a pressure differential between an upper annulus above the seal packer and a lower annulus below the seal packer.

6. The system of claim 4, further comprising:

a valve sleeve including a sidewall and a valve port, the valve sleeve being configured to create a piston force and move towards the distal end of tubing when the seal packer is expanded and pressure is applied in the annulus above the seal packer.

7. The system of claim 6, further comprising:

a stimulation port positioned through the casing, the valve port being configured to align with valve port responsive to the valve sleeve moving towards the distal end of the tubing, fluid being configured to flow through the stimulation port and the valve port when the stimulation port and the valve port are aligned.

8. The system of claim of claim 7, further comprising:

a locking mechanism positioned on the valve sleeve;

a locking element positioned on the tubing, wherein the locking mechanism is configured to interface with the locking element to maintain the alignment of the stimulation port and the valve port.

9. A method for stimulating a well comprising:

positioning a tool within a casing, the tool including a hollow inner chamber extending from a proximal end to a distal end;

flowing fluid through an annulus positioned between an outer diameter of the tool and an inner diameter of the casing;

pulling or pushing, via a dart positioned on a distal end of the tool, a tubing, responsive to the dart receiving the fluid;

moving a check valve between a first mode and a second mode based on a pressure within the hollow inner chamber to cover and uncover a port positioned proximate to the distal end, wherein in a first mode the check valve does not cover the port and in a second mode the check valve does cover the port, the check valve having a first end and a second end, the check valve being configured to move between the first mode and the second mode while positioned within the tool;

moving a piston sleeve positioned on the tool towards the distal end of the tool responsive to the check valve moving from the first mode to the second mode to shear the dart from the distal end; and extending a shifting profile across the annulus responsive to the piston sleeve moving towards the distal end of the casing, wherein the piston sleeve is positioned between the shifting profile and the distal end.

10. The method of claim 9, further comprising:

aligning the shifting profile to engage with a female profile positioned on an inner diameter of the casing to secure the tool in place.

11. The method of claim 10, further comprising:

disengaging the shifting profile from the female profile, to reset the tool when pressure within the inner diameter of the tool decreases.

12. The method of claim 9, further comprising:

expanding a seal packer positioned on the outer diameter of the tool responsive to the check valve covering the port;

creating an upper annulus above the seal packer and creating a lower annulus below the seal packer.

13. The system of claim 12, further comprising:

creating, via a pressure port, a pressure differential between the upper annulus above the seal packer and the lower annulus below the seal packer.

14. The method of claim 12, further comprising:

moving a valve sleeve towards the distal end of the casing when the valve sleeve receives pressure from the annulus above the seal packer, the valve sleeve including a sidewall and a valve port.

15. The method of claim 14, further comprising:

aligning the valve port with a stimulation port positioned through the casing when the valve sleeve moves towards the distal end of the casing;

flowing fluid through the stimulation port and the valve port when the stimulation port and the valve port are aligned.

16. The method of claim 15, further comprising:

interfacing a locking mechanism positioned on the valve sleeve within a locking element positioned on the tubing to maintain the alignment of the stimulation port and the valve port.

17. The method of claim 9, wherein portions of the piston sleeve secure the shifting profile within the tool before the piston sleeve shears the dart.

* * * * *